US005498204A

United States Patent [19]

Anderson et al.

[11] Patent Number: 5,498,204

[45] Date of Patent: Mar. 12, 1996

[54] EAVE VENT

[75] Inventors: Charles R. Anderson, Jacksonville, Tex.; Charles B. Kenrick, Spring Lake, Mich.

[73] Assignee: Builder's Best, Inc., Jacksonville, Tex.

[21] Appl. No.: 391,539

[22] Filed: Feb. 21, 1995

[51] Int. Cl.[6] ..... F23L 17/02

[52] U.S. Cl. ..... 454/359; 454/30

[58] Field of Search ..... 34/235; 126/85 B; 454/260, 347, 353, 359, 361, 363, 30

[56] References Cited

U.S. PATENT DOCUMENTS

| | | | |
|---|---|---|---|
| 3,250,206 | 5/1966 | Strouth | 454/359 |
| 3,285,155 | 11/1966 | Maltenfurt | 454/359 |
| 4,022,117 | 5/1977 | Mallian | 454/359 |
| 4,667,581 | 5/1987 | Hovland | 454/260 |

FOREIGN PATENT DOCUMENTS

| | | | |
|---|---|---|---|
| 166436 | 10/1982 | Japan | 454/260 |

*Primary Examiner*—Harold Joyce
*Attorney, Agent, or Firm*—Price, Heneveld, Cooper, DeWitt & Litton

[57] ABSTRACT

An eave vent for discharge of gases from a dwelling, comprising a housing having a lower horizontal peripheral mounting rim having fastener receiving openings therein, and defining an air flow outlet from the housing, a vertical wall normal to the rim and having a top portion, a hose connector extending from the vertical wall and defining a gas flow inlet to the housing, a diagonal wall having a juncture with and at an angle of about 45° to the vertical wall top portion, to the horizontal rim, and a pair of triangular opposite end walls joining the vertical wall, the horizontal rim and the diagonal wall to enclose the housing, and a rectangular closure flapper pivotally mounted on a horizontal axis at the juncture, depending over the air flow outlet, pivotal out against the diagonal wall with air flow out the outlet to lie flush against the diagonal wall, and pivotal against the vertical wall under reverse air flow.

5 Claims, 3 Drawing Sheets

EAVE VENT

BACKGROUND OF THE INVENTION

This invention relates to eave vents for housing, and particularly to an eave vent for mounting in the horizontal eave of a dwelling, for discharge of vented gas such as air from a clothes dryer, exhaust gas from a gas heater or furnace, or the like.

Vents for appliances such as clothes dryers usually are of the type that extend through the vertical side wall of the house or apartment dwelling, with a hood on the exterior and a vertical flapper inside the hood to prevent reverse air flow. There are known difficulties with this arrangement. Specifically, forced air or other gas flowing down out of the hood tends to cling to the dwelling side wall due to the Bernoulli effect, ultimately striking the ground and reversing to create a back pressure on the vent. This tends to prevent effective flow. Installation instructions typically advise to allow a certain distance between the vent hood and the ground to lessen this action, but still a reverse flow effect is noted. Also, there is normally created a negative gas pressure zone at a location down the wall some distance from the vent so that lint and other debris in the airstream or disturbed from the ground gets deposited on the wall in an unsightly manner.

An alternative to this type of vent is a roof jack where the gas is conducted up through the rooftop. That type of structure, however, involves unwanted added structural alterations, leak potential, etc.

SUMMARY OF THE INVENTION

An object of this invention is to provide an eave vent for appliances such as clothes dryers, gas heaters and the like, configurated such that when installed the discharged gas is immediately removed from the vicinity of the dwelling wall. The device employs the Bernoulli effect advantageously, along the underside of the horizontal eave, to discharge the ejected gas in a fashion avoiding creation of backdraft pressure on the vent, preventing debris collection on the side wall, and yet being relatively simple and low cost to manufacture, and easy to install.

The eave vent has a housing with a lower horizontal peripheral mounting rim having fastener receiving orifices, and defining a gas flow outlet, a vertical wall normal to the rim and having a top portion, a hose connector extending from the vertical wall and defining a gas flow inlet, a diagonal wall having a juncture with and extending from the vertical wall top portion to the horizontal rim, a pair of triangular opposite end walls joining the vertical wall, the horizontal rim and the diagonal wall to enclose the housing, and a closure flapper pivotally mounted on a horizontal hinge axis, depending over the air flow outlet, pivotal out against the diagonal wall under the influence of gas flowing out the outlet, and pivotal against the vertical wall under reverse air flow. The hinge axis is immediately adjacent the diagonal wall such that the flapper will lie flush against the diagonal wall with gas flow out the outlet. The eave vent is circular and the flapper is rectangular, thereby preventing air flow behind the flapper, resulting in decreased turbulence and lower pressure drop by eliminating back pressure on the flapper, thereby increasing the overall differential pressure on the flapper to keep it open. The diagonal wall is at an angle of about 45° to the vertical wall.

These and other objects, advantages and features of the invention will become apparent upon studying the following specification in conjunction with the drawings.

DESCRIPTION OF THE PREFERRED EMBODIMENT

Figure 1:
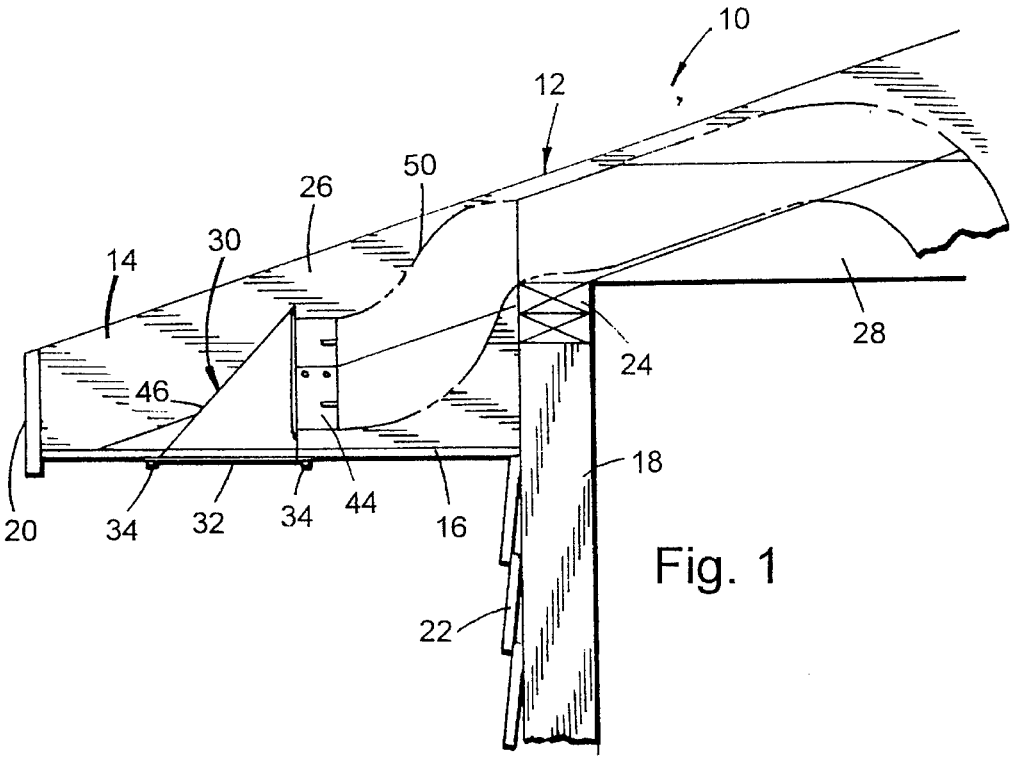
FIG. 1 is a sectional view of a portion of a dwelling, showing the novel eave vent installed.

Referring now specifically to the drawings, the structure depicted in FIG. 1 comprises a dwelling 12, such as a house or an apartment, having an overhanging roofline 14 with a horizontal eave 16 therebeneath extending from the upright structural wall 18 and the outer facia board 20 of the cave and roofline. Wall 18 is shown to have a suitable exterior siding 22 and is typically formed of a plurality of spaced upright studs having a plate 24, e.g., of nominal 2"×4"material, across the top of the studs. The roof typically will include a plurality of spaced rafters 26, e.g., of nominal 2"×8"material. A plurality of joists 28 will typically extend from the underside of the roof and on top of plate 24 to the opposite side of the building and/or to an interior supporting wall, in conventional fashion.

Figure 2:
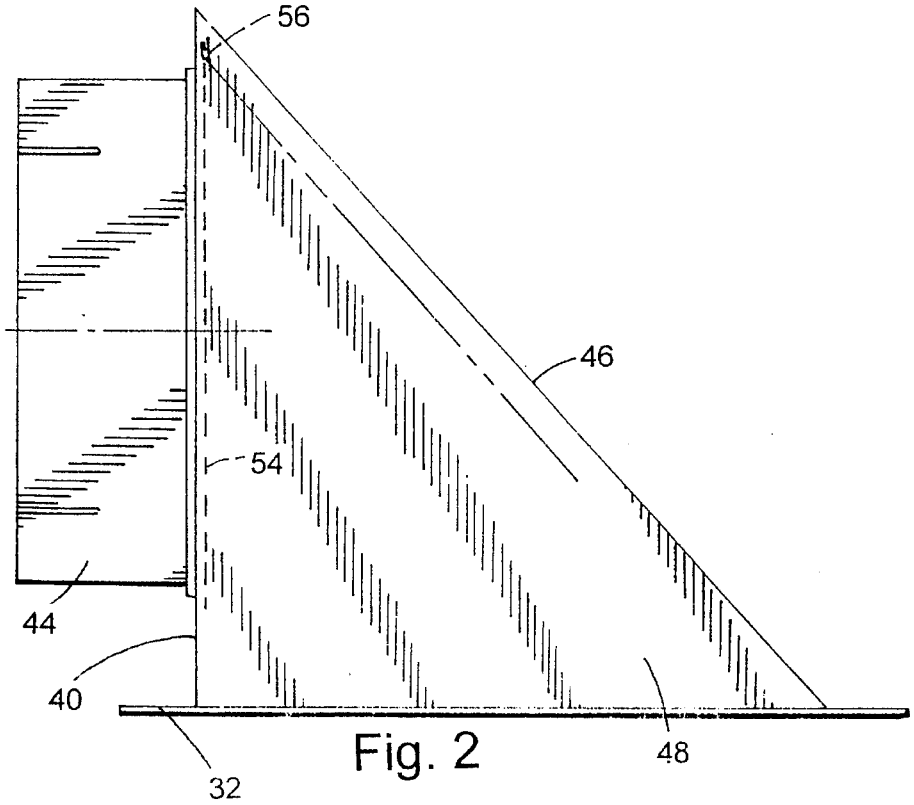
FIG. 2 is an enlarged side elevational view of the eave vent.
Figure 3:
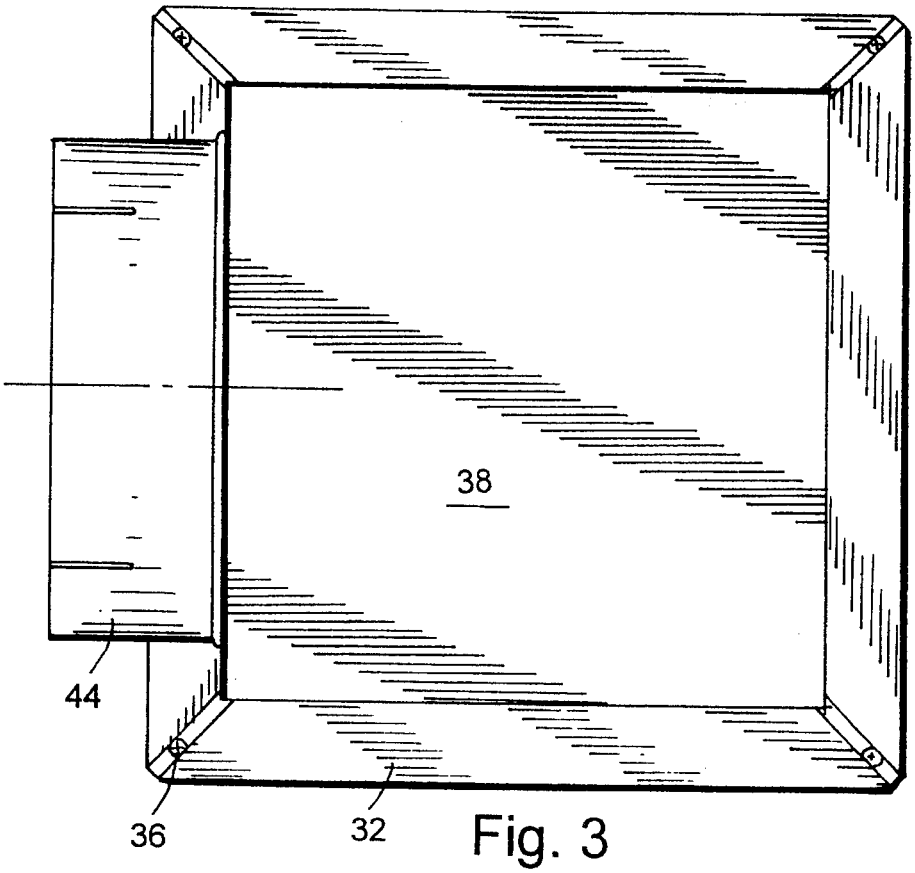
FIG. 3 is a top view of the novel cave vent.
Figure 5:
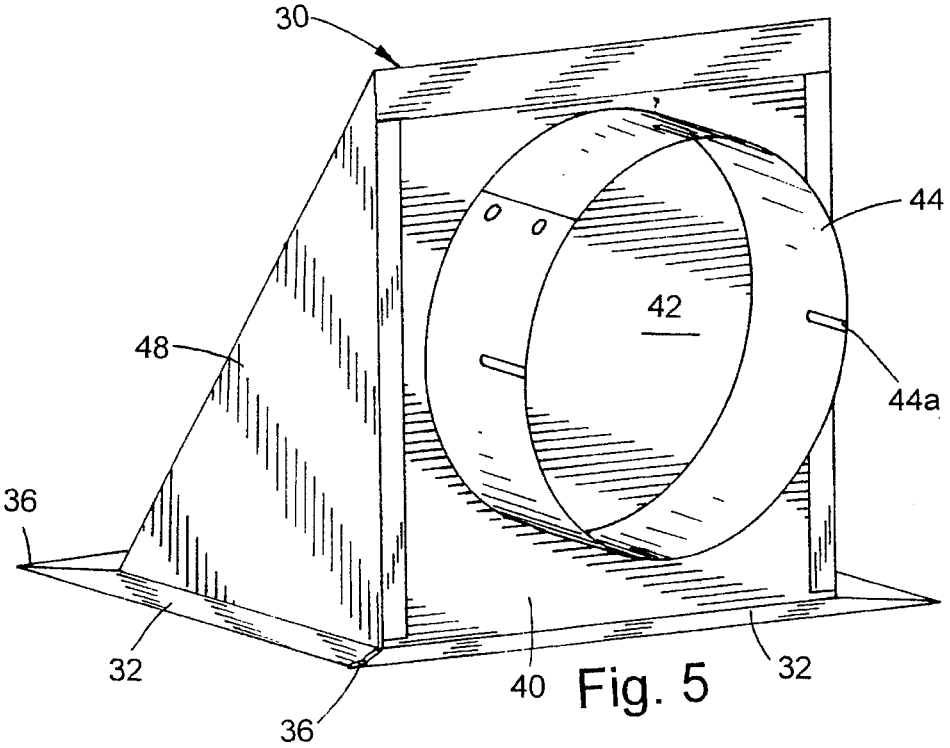
FIG. 5 is a perspective view of the novel structure.
Figure 6:
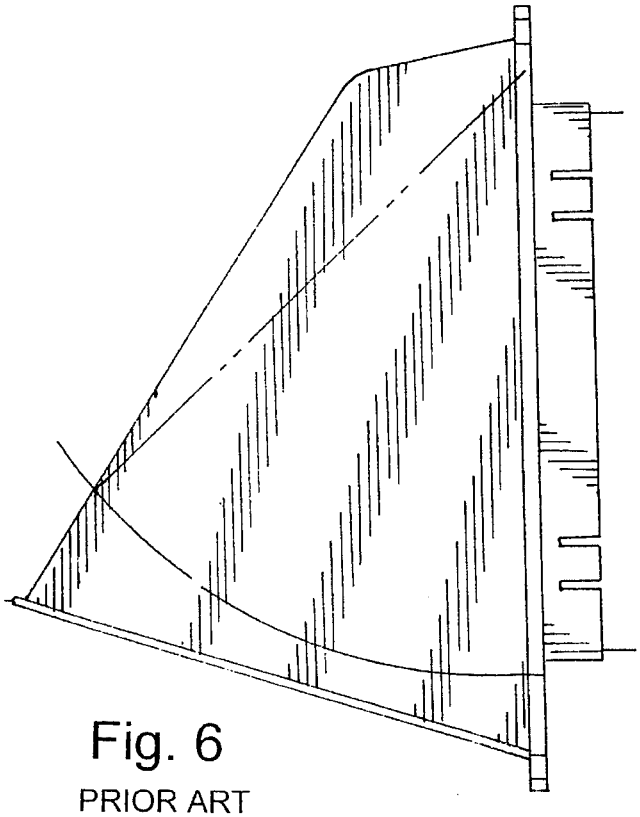
Fig. 6 PRIOR ART
FIG. 6 is a side elevational view of a prior art through-wall vent structure.

Mounted to the underside eave 16 is the novel cave vent 30 which fits into an opening in the cave. More specifically, the cave vent includes a housing having a lower horizontal peripheral mounting rim 32 which has fasteners 34 extending through a plurality of fastener receiving openings 36 (FIG. 3) shown here to be at the corners. This cave vent is preferably formed of sheet metal. This peripheral rim defines a gas flow outlet 38 (FIG. 3) of generally rectangular configuration and shown here to be square to have more volume to push air through. Extending vertically upwardly from rim 32 is a vertical wall 40 comprising a sheet metal panel having a circular opening 42 therein (FIG. 5). Extending around opening 42 is a cylindrical hose connector 44 slotted as at **44*a* to allow slight radial adjustability of this connector for optimum connection to a typical flexible hose 50. Hose 50 can extend from the inlet connector of eave vent 30 up between the rafters and joists in the fashion depicted in FIG. 1 and eventually to the source of the gases, e.g., a clothes dryer or furnace. A diagonal wall 46 extends from the top portion of vertical wall 40, diagonally away from vertical wall 40, to join horizontal rim 32. Integrally connected to all three of these walls, namely the horizontal rim 32, vertical wall 40, and diagonal wall 46, are a pair of triangular end panels 48 to close the housing. A closure flapper 54 of square configuration and normally of sheet metal is pivotally mounted along its upper horizontal edge by an integral pivot sleeve 56 adjacent the juncture of diagonal wall 46 with vertical wall 40 such that pivotal movement from the vertical closed position (FIG. 2) to the diagonal open position will cause the flap to lie flush against the inside surface of diagonal wall 46 when gas is being forcefully discharged through the vent. The sleeves 56**

Figure 4:
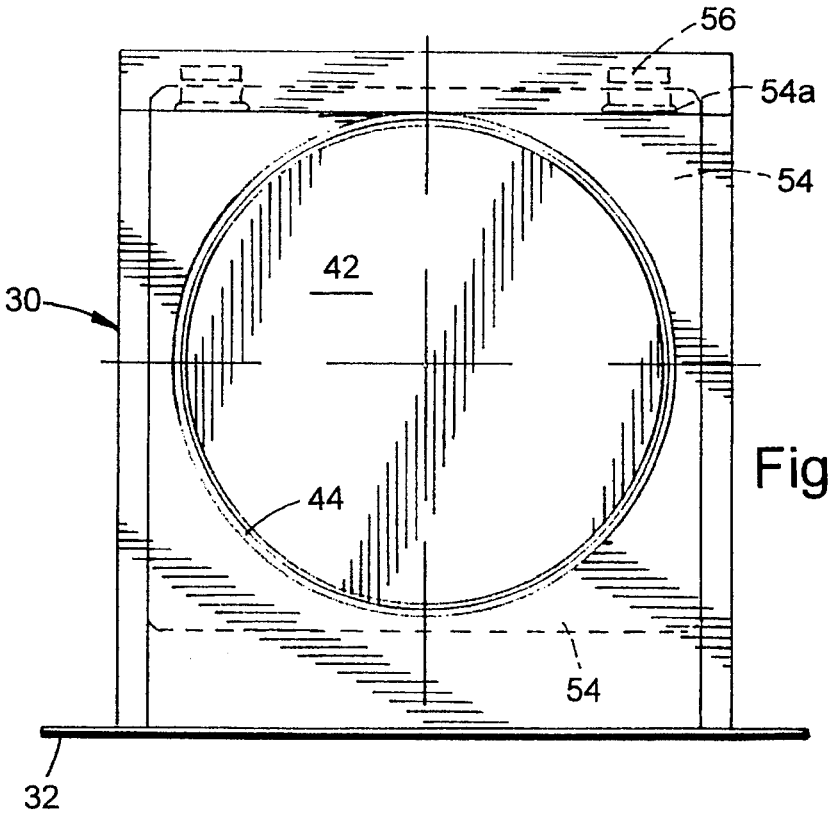
FIG. 4 is a side elevational view from the left side of the structure in FIG. 2.

(FIGS. 2 and 4) extend through slots 54*a* in flapper 54 and cuff upwardly to provide the pivotal connection. It has been found that the square configuration of this flapper fitted within the parallel vertical side walls or end walls 48 assures minimal air flow behind the flapper when air is being discharged, to prevent back pressure on the flapper tending to close it and thus unwanted pressure drop. The edges of the flapper are preferably closely adjacent the triangular end walls 48. The diagonal wall 46 is at an angle of about 45°, preferably at least 45° to vertical wall 40, to take maximum advantage of the Bernoulli effect of gas flow along the underside of the eave.

When gas such as hot air or exhaust gas is forced through duct 50 and connector 44 into inlet 42 of the housing, it forces flapper 54 to an open position flush against diagonal wall 46, causing the air or other gas to change direction from the horizontal to a diagonal flow along the flapper and diagonal wall 46 to outlet 38, where it tends to flow horizontally along the underside of eave 16 due to the Bernoulli effect, jettisoning generally horizontally, or at least diagonally outwardly, away from the dwelling, for rapid dissipation therefrom. This alleviates back flow and back pressure problem resulting from the usual downward flow and Bernoulli effect along the outside vertical wall surface, to cause the gas to strike the ground and reverse. It also eliminates debris collection along the side wall of the structure, characteristic of prior units.

Various minor changes could conceivably be made in the apparatus within the inventive concept, which is intended to be limited only by the scope of the appended claims and the reasonably equivalent structures to those defined therein.

The embodiments of the invention in which an exclusive property or privilege is claimed are defined as follows.

1. An eave vent for discharge of gases from a dwelling, comprising:

a housing having a lower horizontal peripheral mounting rim having fastener receiving openings therein, and defining an air flow outlet from said housing, a vertical wall normal to said rim and having a top portion, a hose connector extending from said vertical wall and defining a gas flow inlet to said housing, a diagonal wall having a juncture with and extending from said vertical wall top portion to said horizontal rim, and a pair of triangular opposite end walls joining said vertical wall, said horizontal rim and said diagonal wall to enclose said housing; and a closure flapper pivotally mounted on a horizontal pivot axis at said juncture, depending over said air flow outlet, and pivotal out against said diagonal wall with air flow out said outlet.

2. The eave vent in claim 1 wherein said pivot axis is immediately adjacent said diagonal wall such that said flapper will lie flush against said diagonal wall with air flow out said outlet.

3. The eave vent in claim 1 wherein said inlet is circular and said flapper is rectangular.

4. The eave vent in claim 1 wherein said diagonal wall is at an angle of about 45° to said vertical wall.

5. The eave vent in claim 4 wherein said angle is at least about 45°.

* * * * *

UNITED STATES PATENT AND TRADEMARK OFFICE

CERTIFICATE OF CORRECTION

PATENT NO. : 5,498,204
DATED : March 12, 1996
INVENTOR : Charles R. Anderson et al.

It is certified that error appears in the above-identified patent and that said Letters Patent is hereby corrected as shown below:

Column 2, line 11;

"cave" should be –eave–.

Column 2, line 26;

"cave" should be –eave–.

Column 2, line 36;

"cave" should be –eave–.

Column 2, line 37;

"cave" should be –eave–.

UNITED STATES PATENT AND TRADEMARK OFFICE

CERTIFICATE OF CORRECTION

PATENT NO. : 5,498,204
DATED : March 12, 1996
INVENTOR : Charles R. Anderson et al.

It is certified that error appears in the above-identified patent and that said Letters Patent is hereby corrected as shown below:

Column 2, line 38;

"cave" should be –eave–.

Column 2, line 41;

"cave" should be –eave–.

Column 3, line 2;

"cuff" should be –curl–.

Signed and Sealed this

Eighth Day of October, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,498,204
DATED : March 12, 1996
INVENTOR(S) : Charles B. Anderson and Charles R. Kenrick It is certified that error appears in the above-identified patent and that said Letters Patent is hereby corrected as shown below:

ON THE TITLE PAGE:

Item [75] Inventors Names should be as follows:

Charles B. Anderson and Charles R. Kenrick

Signed and Sealed this

Twelfth Day of May, 1998

Bruce Lehman

*Attest:*

BRUCE LEHMAN

*Attesting Officer*

*Commissioner of Patents and Trademarks*